US005592757A

United States Patent [19]

Jackinsky

[11] Patent Number: 5,592,757

[45] Date of Patent: Jan. 14, 1997

[54] SHOE WITH WALKING SOLE

[76] Inventor: Carmen U. Jackinsky, 18815 SW. Honeywood Ct., Aloha, Oreg. 97006

[21] Appl. No.: 409,886

[22] Filed: Mar. 21, 1995

Related U.S. Application Data

[63] Continuation of Ser. No. 205,595, Mar. 2, 1994, abandoned.

[51] Int. Cl.[6c] ..... A43B 13/00; A43B 5/00; A43B 13/14

[52] U.S. Cl. ..... 36/114; 36/25 R; 36/31; 36/127

[58] Field of Search ..... 36/28, 25 R, 31, 36/30 R, 132, 136, 127

[56] References Cited

U.S. PATENT DOCUMENTS

| | | | |
|---|---|---|---|
| Re. 31,173 | 3/1983 | Daswick | 36/30 R |
| 1,011,460 | 12/1911 | Maddocks | 36/29 |
| 1,984,989 | 12/1934 | Reed | 36/25 |
| 2,214,052 | 9/1940 | Good | 36/132 X |
| 2,847,769 | 8/1958 | Schlesinger | 36/144 X |
| 3,305,947 | 2/1967 | Kalsoy | 36/25 |
| 3,964,181 | 6/1976 | Holcombe, Jr. | 36/25 R X |
| 3,990,159 | 11/1976 | Borgeas | 36/101 |
| 4,012,854 | 3/1977 | Berend et al. | 36/29 |
| 4,041,619 | 8/1977 | Sapper | 36/25 R |
| 4,155,180 | 5/1979 | Phillips | 36/129 |
| 4,262,433 | 4/1981 | Hagg et al. | 36/25 R |
| 4,348,821 | 9/1982 | Daswick | 36/103 |
| 4,364,188 | 12/1982 | Turner et al. | 36/31 |
| 4,399,620 | 8/1983 | Funck | 36/28 X |
| 4,425,721 | 1/1984 | Spronken | 36/132 X |
| 4,461,104 | 7/1984 | Galkin et al. | 36/132 |
| 4,494,322 | 1/1985 | Klagmann | 36/28 |
| 4,589,216 | 5/1986 | Fuscone | 36/25 R X |
| 4,689,898 | 9/1987 | Fahey | 36/144 X |
| 4,694,591 | 9/1987 | Banich et al. | 36/30 X |
| 4,730,402 | 3/1988 | Norton et al. | 36/30 R |
| 4,757,620 | 7/1988 | Tiitola | 36/28 |
| 4,811,504 | 3/1989 | Bunke | 36/132 |
| 4,843,672 | 7/1989 | Fasse | 36/132 X |
| 4,934,073 | 6/1990 | Robinson | 36/91 |
| 4,949,476 | 8/1990 | Anderie | 36/129 |
| 4,958,445 | 9/1990 | Brisco | 36/132 X |
| 5,031,342 | 7/1991 | Crook | 36/135 |

FOREIGN PATENT DOCUMENTS

| | | |
|---|---|---|
| 0362185 | 4/1990 | European Pat. Off. . |
| 0386770 | 9/1990 | European Pat. Off. . |

OTHER PUBLICATIONS

*Boot and Shoe Recorder,* May 1973, p. 26.

"Footwear: Down at the Heels", *Newsweek,* Oct. 14, 1974, p. 75.

"The Earth Shoe", *Consumer's Research Magazine,* Feb. 1975, pp. 25–26.

"Is There Anything Positive About Negative–Heel Shoes?", *Today's Health,* Dec. 1975, pp. 36, 37 and 39.

"Incorporating Increased Mechanical Efficiency into the Design of Running Shoes", 1979, by E. C. Frederick, Ph.D.

*Primary Examiner*—B. Dayoan

*Attorney, Agent, or Firm*—Kolisch, Hartwell, Dickinson, McCormack & Heuser

[57] ABSTRACT

A unique shoe is provided to improve a walker's power, posture and speed, such shoe combining the advantages of a forwardly-inclined heel with the advantages of an arcuately tapered toe. The shoe includes an upper which carries the wearer's foot, and a sole which supports the foot from below. The sole is formed with two portions, a generally wedge-shaped rear portion which extends from an area beneath the wearer's heel to an area beneath the ball of the wearer's foot, and an arcuate forward portion which extends forwardly from the area beneath the ball of the wearer's foot to the forward terminus of the shoe. The rear portion increases linearly in thickness in the forward direction, the sole's overall thickness being correspondingly increased. The forward portion is of forwardly decreasing thickness, the sole tapering arcuately to forward termination of the shoe.

11 Claims, 2 Drawing Sheets

SHOE WITH WALKING SOLE

This is a continuation of application Ser. No. 08/205,595 filed Mar. 2, 1994, abandoned.

TECHNICAL FIELD

The present invention relates generally to footwear, and more particularly, to a shoe which has been adapted to improve a walker's power, posture and speed. This is accomplished via a unique sole arrangement which optimizes shoe efficiency by optimizing orientation of the wearer's foot throughout a walking stride. Although the invented shoe provides benefits which extend to all forms of footwear, it has proven especially effective for use by race walkers and is described in the context of race walking below.

BACKGROUND

In recent years, there has been an explosion in the physical fitness industry, and correspondingly, in the desire for equipment which improves an individual's performance of activities which promote good health. One area which has experienced particular growth involves low-impact cardiovascular exercise, an endeavor known to improve physical condition without unduly taxing an individual's joints. Activities such as walking have thus become popularized, and have developed into competition sports such as race walking. The sport serves as an increasingly popular form of exercise and recreation, attracting persons of diverging levels of skill and physical ability. The fitness industry, however, has been slow in recognizing this trend, and has yet to develop an acceptable walking shoe. Walkers have thus been forced to make do with running shoes, shoes designed to accommodate a high impact activity which requires very different foot posture, impact absorption, and overall shoe use. A need has thus developed for a shoe which is designed particularly for use by walkers.

Focusing for a moment on walking technique, it is to be appreciated that walking consists of a series of steps, each step constituting a cycle wherein the walker shifts from a single support phase ("SSP"), to a double support phase ("DSP"), and then back to the single support phase. In the single support phase, the walker's entire weight is balanced on one foot, the other foot being moved forwardly so as to move the walker into the double support phase. In the double support phase, the walker's weight is balanced between a leading and a trailing foot. The trailing foot is used to push the walker forward so as to again enter the single support phase, and begin the cycle anew. The aforementioned "push-off" begins during the single support phase when the walker's center of gravity (COG) passes over the supporting foot. The walker, at all times, has at least one foot in contact with the ground, reducing the impact associated with each step, and resulting in an overall healthier exercise routine.

With each step, the athlete's forward foot lands on the heel, and moves forward to a planted position with the heel and ball of the foot supported from below. The ball of the foot acts as a fulcrum, the walker's foot pivoting forward about such fulcrum as his or her center of gravity passes thereover. This accommodates push-off by the walker's toes. The walker may not push-off with the trailing foot until the leading foot is planted so as to provide the walker with a stable support. A slight forward lean, on the order of approximately 5-degrees from vertical, provides the walker with an ideal walking posture and helps with forward momentum. Such lean should be from the ankles, rather than from the waist because a forward bend from the waste shortens the walker's stride and compromises breathing power by cramping his or her lungs.

In a conventional shoe, the wearer's heel is elevated relative to the toes and the ball of the foot when the foot is planted. This arrangement leads to improper walking posture, and detracts from the wearer's walking power and walking speed. Because of the forwardly declining orientation of the wearer's foot, the wearer will tend to stand with his or her body reclined slightly so as to maintain balance. This results in an unhealthy posture and increases the likelihood of injury to the walker's lower torso. Conventional shoes also detract from walking efficiency because it is necessary to provide a sole with an undersurface which is generally planar from the shoe's heel to the tip of its toe. Such a planar surface is made necessary in order to provide adequate balance for the wearer in view of the elevated heel. The planar sole makes push-off more difficult, the wearer being required to provide a force which will both provide motive force and bend the forepart of the shoe.

It is therefore a general object of the invention to provide a shoe which is designed to facilitate walking, and more particularly, to increase walking speed.

Another general object of the invention to provide a shoe which enhances the wearer's power and endurance by promoting proper walking posture so as to reduce the risk of injury and improve the efficiency and power of a wearer's steps.

It is a further object of the invention to provide a shoe with a sole which inclines the wearer's foot forwardly relative to the bottom surface of the shoe.

Still another object of the invention is to provide a shoe which employs a sole configured to act as a lever, allowing the wearer's interior tibialis to relax, while the larger calf muscle is used to provide the motive force.

It is further desired to provide a shoe which more readily shifts the athlete's center of gravity forward onto a forward portion of the shoe so as to throw the walker forward, shortening the double support phase, and correspondingly, increasing the walker's speed.

SUMMARY OF THE INVENTION

In accordance with the present invention, a unique shoe arrangement is provided, such shoe combining the advantages of a forwardly-inclined heel with the advantages of an arcuately tapered toe. The invented arrangement thus facilitates improved walking posture, increased power and endurance, and increased walking speed. This is accomplished via a shoe having an upper which carries the wearer's foot, and a sole which supports the foot from below. The sole preferably is constructed from three sole sections, the three sections being combined to define a cooperative structure which improves the walking posture of the wearer's foot. In its preferred form, the sole sections include an insole, a midsole, and an outsole, the midsole being most effective in defining the posture of the wearer's foot. Toward this end, the midsole may be considered to include two portions, a generally wedge-shaped rear portion which extends from an area beneath the wearer's heel to an area beneath the ball of the wearer's foot, and an arcuate forward portion which extends forwardly from the area beneath the ball of the wearer's foot to the forward termination of the shoe. The rear portion increases linearly in thickness in the forward direction, the sole's overall thickness being correspondingly increased. The forward portion is of forwardly decreasing thickness, tapering arcuately to termination in an area forward of the wearer's toes.

By virtue of the wedge-shaped heel portion, the sole is intended to encourage forwardly-inclined planting of the wearer's foot. It will thus be apparent that the rear portion extends from a load-bearing area beneath the wearer's heel to a load-bearing area beneath the ball of the wearer's foot. Because proper walking form requires heel-to-toe planting of the walker's foot, it should also be appreciated that use of such an arrangement will lead to earlier planting of the wearer's foot. Once the foot is planted, the walker's forward momentum, in combination with a push-off force by the trailing foot, will tend to shift the walker's center of gravity forwardly until the center of gravity passes over the forward load bearing area. At such time, the leading foot transitions to a trailing foot, the walker's weight being pivoted about the area of the sole which underlies the ball of the wearer's foot. Because of the arcuate nature of the forward portion, bending of the shoe is minimized, decreasing the amount of energy required to push-off. Such arcuate taper also makes for a smoother transition to the push-off orientation, and enhancing the wearer's stability due to the so-called "rolling effect".

In order to further enhance stability, the shoe's midsole preferably is formed with a resilient foundation region which includes the first and second load-bearing areas, and a less resilient perimeter region which extends at least partially along the perimeter of the midsole. This configuration opposes sideways distortion of the sole, and thus avoids supination, pronation, turned ankles or the like. Because the foundation region is resilient, the shoe also cushions impact of the wearer's foot during walking, and provides additional spring effect during push-off where the foundation region extends into the forward portion of the sole as is preferred.

These and other objects and advantages of the present invention will be more readily understood after a consideration of the drawings and the detailed description of the preferred embodiment which follows.

DETAILED DESCRIPTION OF THE PREFERRED EMBODIMENT AND BEST MODE FOR CARRYING OUT THE INVENTION

As stated above, the present invention relates to a new walking shoe, such shoe being constructed to promote proper walking posture, to improve walking efficiency, and to increase walking speed. The shoe accomplishes these tasks by facilitating early planting of a wearer's lead foot, by accommodating smooth transition of the foot from a planted orientation to a push-off orientation, and by enhancing stability and power when the wearer pushes off. Although useful during various walking exercises, the invented shoe has demonstrated particular utility in sport of race walking and is described in the context of a race walking shoe below. It is to be appreciated, however, that the invented shoe may be adapted for use in the context of virtually any walking shoe style.

Figure 1:
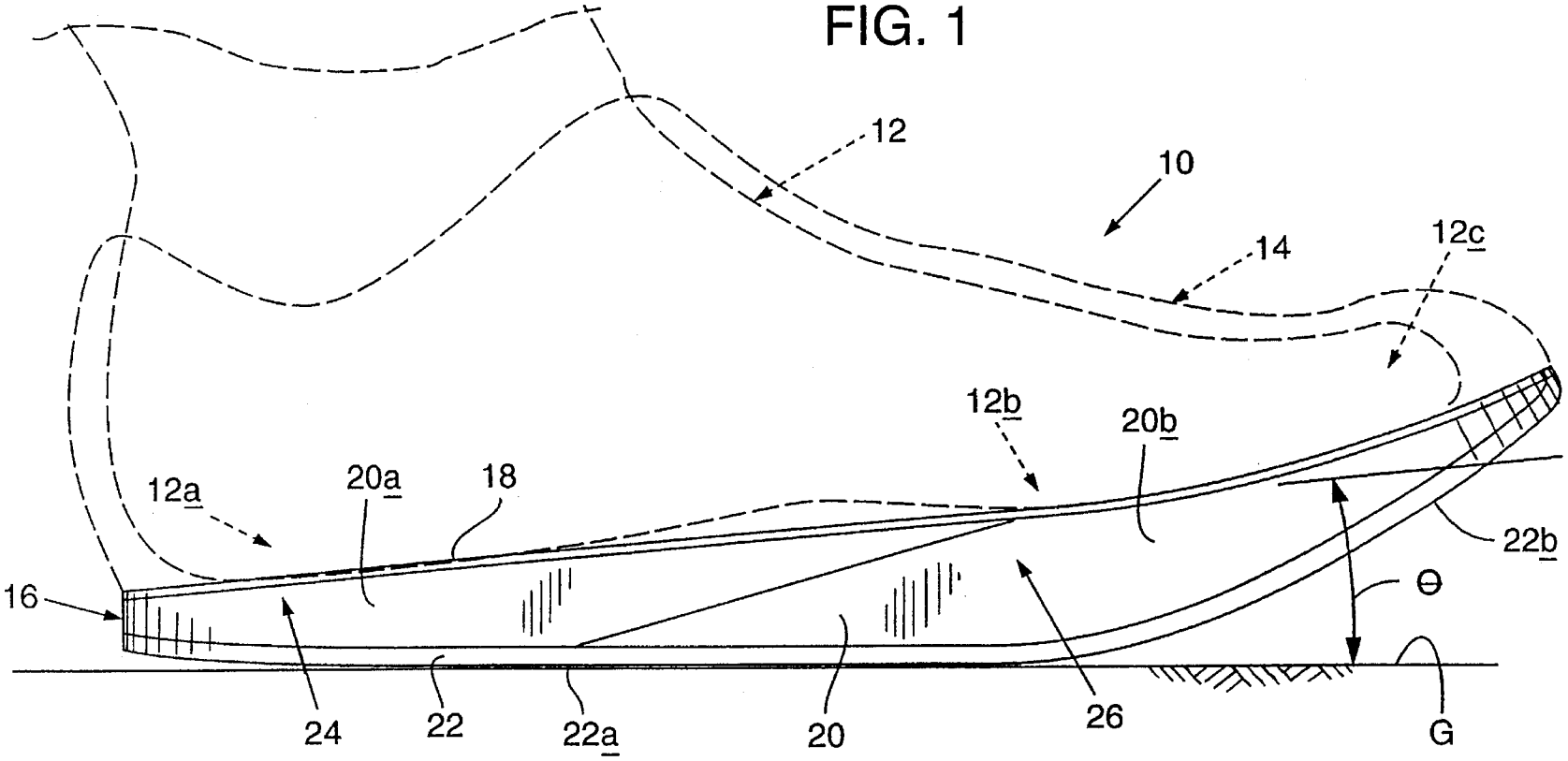
FIG. 1 is a side elevational view of a shoe formed in accordance with the invention, the shoe being shown in its planted orientation relative to the ground.
Figure 3:
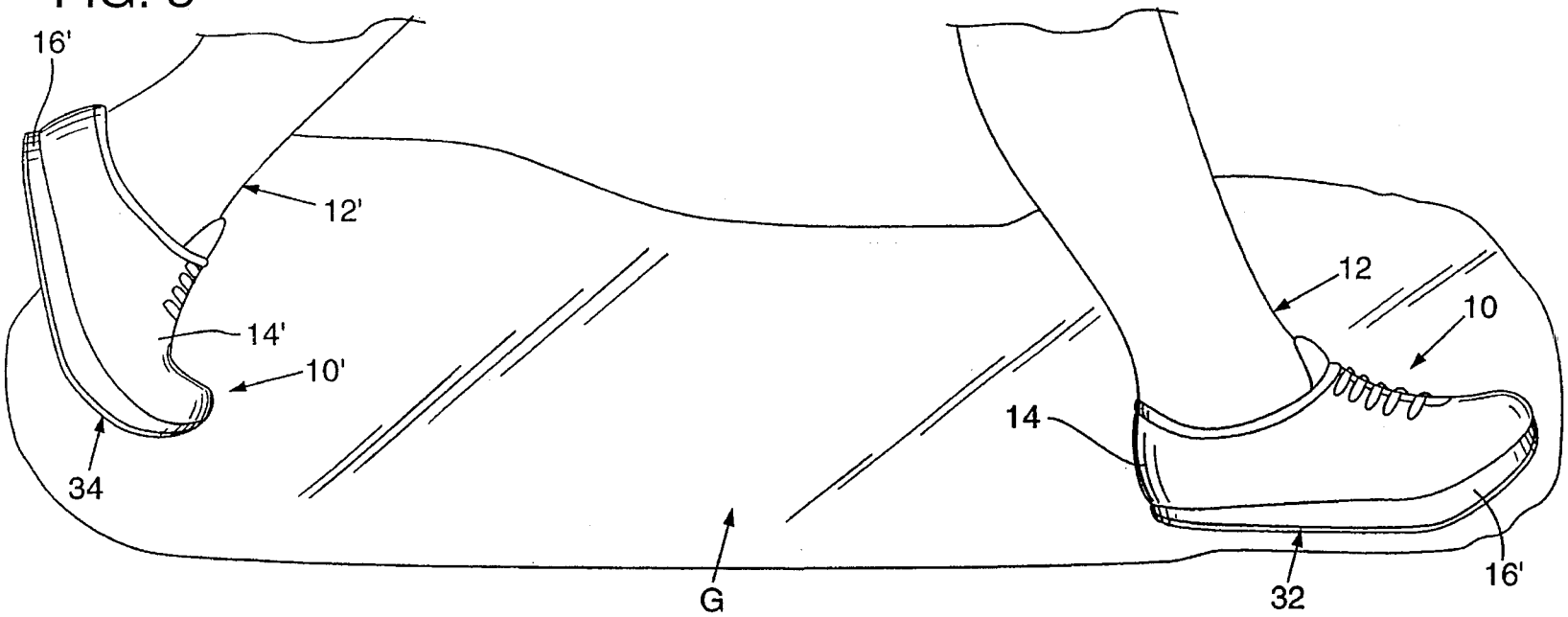
FIG. 3 illustrates the foot arrangement of a walker during a double support phase of a walking stride, the walker being fitted with a pair of shoes formed in accordance with a preferred embodiment of the invention.

Turning now to the drawings, and referring specifically to FIG. 1, the reader will note that a shoe formed in accordance with the present invention has been depicted, such shoe being indicated generally at 10. From the drawing, it should be apparent that shoe 10 is configured for fitted securement to a foot 12 (shown in dashed lines), the shoe including an upper 14 (also shown in dashed lines) and a sole 16. The shoe's upper may be of any conventional design capable of holding a wearer's foot, but preferably is in the form of a conventional athletic shoe upper as illustrated in FIG. 3. The upper generally is constructed of canvas, leather, or some other material conventionally used in the manufacture of walking or sport shoes. In its preferred form, the upper envelopes the wearer's foot, the sole being secured to the upper so as to support the foot from below. The upper and sole are combined by a conventional securement arrangement such as by adhesive or stitching, arrangements which have proven effective in the past.

Focussing initially on sole 16, it will be noted that such sole is of unique design, being characterized by the inclusion of both a negative heel and of an arcuately tapered toe. The sole is assembled of three sole sections, the three sections being combined to define the cooperative structure shown in FIG. 1. This structure is intended to improve the walking posture of the wearer's foot, a posture defined herein as the orientation of the foot relative to the ground. In its preferred form, the sole includes an inner section (or insole) 18, a middle section (or midsole) 20, and an outer section (or outsole) 22, the three being combined by a conventional arrangement such as those described in connection with combination of the upper and sole. The sole's dimensions are dependent on the shoe size, but are depicted illustratively assuming a size-8½ men's shoe.

As best indicated in FIG. 1, insole 18 is that section of the sole which most directly underlies the wearer's foot, extending substantially the length of the shoe to provide a bed on which the wearer's foot rests. The insole preferably is formed from a conventional fabric, providing a comfortable seat for the wearer's foot. In the depicted embodiment, the insole takes the form of a thin sheet, but may alternatively be shaped to conform to the contours of a wearer's foot so as to provide additional foot support. Although the insole is described herein as a separate section of the shoe's sole, those skilled will appreciate that the insole may alternatively be defined as an uppermost section of the shoe's sole where the insole and midsole are unitarily formed, or as a removable insert.

Like the shoe's insole, outsole 22 takes the form of a thin sheet applied to the shoe's midsole along an expanse extending substantially the length of the shoe. The outsole, however, extends along the bottom of the midsole so as to provide a walking surface for the shoe. As indicated, the shoe's walking surface 22 preferably includes a generally planar planting surface **22*a* which extends from the rear of the shoe to an area underlying the ball of the wearer's foot, and a generally arcuate roll surface 22*b*** which extends from the area underlying the wearer's foot to the forward terminus of the shoe. This arrangement results from the shape of the shoe's midsole, such midsole defining the sole's overall thickness as will be described below. The shoe's outsole may be formed unitarily with the midsole, the outsole being defined as the lowermost section of the shoe's sole.

Although not shown, it will be appreciated that outsole 22 may be provided with a tread design so as to improve traction of the shoe. It should also be appreciated that the outsole is preferably formed from a firm, stable material with frictional characteristics which facilitate adherence to the ground. A high density rubber, for example, is commonly used. Such a dense material will tend to extend shoe life, and will provide adequate protection for the wearer's foot.

Referring now to the shoe's midsole 20, it is to be noted that the midsole may be considered to include two portions, a generally wedge-shaped rear portion 20*a*, and an arcuate forward portion 20*b*. The rear portion extends from the rear of the shoe (below the wearer's heel 12*a*) to the shoe's pivot (below the ball of the wearer's foot 12*b*). The forward portion extends from the shoe's pivot to the forward termination of the shoe. As should be apparent from the drawings, the rear portion increases in thickness in the forward direction, reaching its maximum thickness in the area underlying the ball of the foot. The shoe's forward portion is of forwardly decreasing thickness, tapering arcuately to termination at the forward end of the shoe. This arrangement provides for improved planting of the foot as shown in FIG. 1, and improved push-off as will be described below.

The shoe's midsole is interposed the insole and outsole, the midsole serving to define the unique profile of the invented shoe. This profile generally is consistent across the shoe's width and is characterized by a thickness which is at a maximum in that part of the sole which underlies the ball of the wearer's foot. The sole's thickness will thus be understood to increase linearly in a forward direction from that part of the sole which underlies the wearer's heel to that part of the sole which underlies the ball of the wearer's foot. Also, the sole's thickness decreases arcuately in the forward direction from the part of the sole underlying the ball of the foot to the forward terminus of the sole.

The portion of the sole which is of linearly increasing thickness may be considered to correspond to the midsole's rear portion 20*a*, the inclined expanse extending between a first load-bearing area (indicated generally at 24) and a second load-bearing area (indicated generally at 26). The first load-bearing area underlies the wearer's heel 12*a*, and the second load-bearing area underlies the ball of the wearer's foot 12*b*. These load-bearing areas, or points (in their simplest sense), optimally bear the bulk of the weight supported by a planted foot.

The portion of the foot which is of arcuately decreasing thickness may be considered to correspond to the midsole's forward portion 20*b*, the arcuate expanse extending between the second load-bearing area 26 and the forward terminus of the sole. The sole thus defines a fulcrum or pivot immediately below the ball of the wearer's foot, accommodating forward roll of the foot from the planted orientation (shown in FIG. 1) to the push-off orientation (shown at 34 in FIG. 3). Also, the arcuate expanse underlies that portion of the foot which is used to push-off during walking, a feature which will be appreciated more fully upon reading further.

Figure 2:
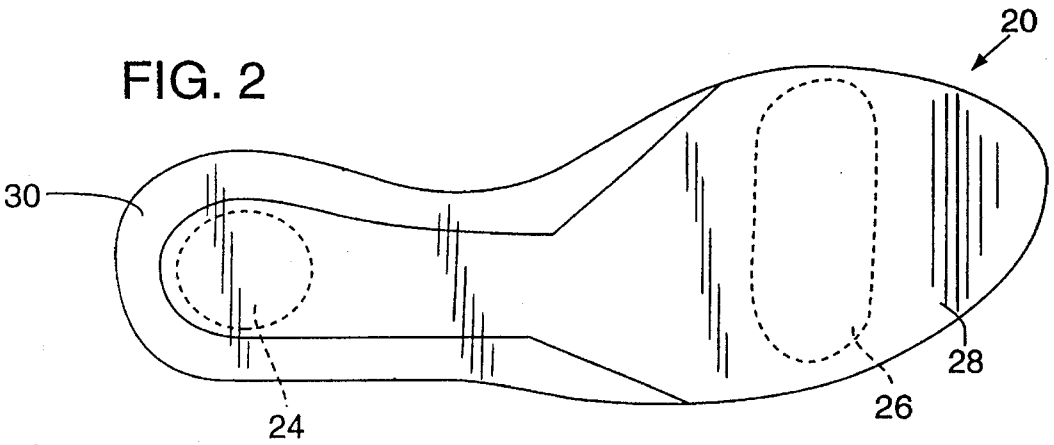
FIG. 2 is a plan view of a midsole which forms a part of the shoe depicted in FIG. 1.

Referring now to FIG. 2, it is to be noted that the midsole may be formed with differential stiffness characteristics, the depicted midsole being shown to include a resilient foundation region 28 and a less resilient perimeter region 30. As indicated, the foundation region includes a substantial part of the midsole, including those parts which define the first load-bearing area 24 and the second load-bearing area 26. In the preferred embodiment, the foundation region is formed from a foam rubber (such as Phylon®) which has a durometer of between approximately 48 and 54 so as to adequately cushion impact of the wearer's foot when walking. This arrangement also provides additional spring effect during push-off.

In order to enhance stability of the shoe, perimeter region 30 is formed to extend at least partially about the perimeter of the midsole, providing improved support for the perimeter of the shoe. In the depicted embodiment, the perimeter region extends about the exterior perimeter of the midsole's rear portion, significantly reducing the risk of a turned ankle during planting of the shoe. Like the above-described foundation region, the perimeter region is formed from a foam rubber, but the perimeter region's durometer is preferably within the range of between approximately 67 and 73.

Turning now to the shoe's use, and referring specifically to FIGS. 1 and 3, it is to be noted that the invented shoe is intended for use in pairs, one such shoe being placed on each of the wearer's feet. FIG. 3 illustrates such a shoe pair, shoes 10 and 10' being illustrated during a typical walking stride. The shoes are shown and described with similar reference designators, the only difference between the shoes being that one is a left shoe and the other is a right shoe.

As previously described, walking consists of a series of steps, each step constituting a cycle wherein a walker shifts from a single support phase (FIG. 1) to a double support phase (FIG. 3), and then back to the single support phase. In the single support phase, the walker's entire weight is balanced on one foot, the other foot being moved forward so as to move the walker into the double support phase. In the double support phase, the walker's weight is balanced between a leading foot 12 and a trailing foot 12'. The trailing foot is used to push the walker forward so as to again enter the single support phase, and begin the cycle anew. Push-off begins during the single support phase when the walker's center of gravity passes over the supporting foot.

With each step, an individual's forward foot lands on the heel, and moves forward to a planted position with the heel and ball of the foot supported from below (see foot 12 in FIGS. 1 and 3). The ball of the foot acts as a fulcrum, the walker's foot pivoting forward about such fulcrum as his or her center of gravity passes thereover. This accommodates push-off by the walker's toes (see foot 12' in FIG. 3). The walker may not push-off with the trailing foot until the leading foot is planted so as to provide the walker with a stable support.

When a walker's foot is planted, as in the single support phase orientation shown in FIG. 1, the walker's weight rests on the shoe's planting surface, the principal components of such weight being distributed between the first and second load-bearing areas of the sole. These areas, it will be recalled, underlie the heel and ball of the wearer's foot, respectively. The thickness of the sole in these areas is thus important in determining the posture of the wearer's foot when planted, the disparity in sole thickness defining the forward incline of the foot relative to the plane of the ground G. A similar arrangement results when the walker is in the double support phase.

In the preferred embodiment, the midsole's angle of incline is generally between 2-degrees and 6-degrees from the plane of the ground as indicated by angle θ in FIG. 1. The sole is thus intended to encourage forwardly-inclined planting of the wearer's foot. An incline angle of 5-degrees from the ground is preferably chosen, such angle having been established as an angle which encourages proper walking posture, a slight forward lean of the wearer's body. Those skilled will appreciate that such lean is encouraged by the present shoe in view of the shoe's forward incline, the wearer tending to lean forward so as to maintain his or her balance. It will be noted, however, that alternative incline angles may be chosen in accordance with the desired speed of person wearing the shoe. Faster walkers, for example, will perform best with a shoe having an incline angle closer to 6-degrees, the greater angle accommodating improved roll-over momentum and thus a faster walking speed. Slower walkers will be most comfortable in a shoe having an incline angle closer to 2-degrees, providing shoe suitable for use during a more conventional walking pace.

Because proper walking technique requires heel-to-toe planting of the walker's foot, it should also be appreciated that use of the invented sole arrangement will lead to earlier planting of the wearer's leading foot, and correspondingly, earlier push-off by the wearer's trailing foot. Once the leading foot is planted (as shown at 32 in FIG. 3), the walker's forward momentum, in combination with the push-off force by the trailing foot (as shown at 34 in FIG. 3), will tend to shift the walker's center of gravity forwardly. This allows the wearer to begin push-off while still in the double support phase. As a result, the double support phase is shortened, substantially increasing the walker's speed.

The leading foot will eventually transition to a trailing foot, the walker's weight being pivoted about the area of the sole which underlies the ball of the wearer's foot. Due to the arcuate nature of the sole's forward end, bending of the shoe is minimized, decreasing the amount of energy required to push-off. Such arcuate taper also makes for a smoother transition to the shoe's push-off posture, and enhances the wearer's stability due to a rolling effect of the sole.

While the present invention has been shown and described with reference to the preferred embodiment, it will be apparent to those skilled in the art that various changes in form and detail may be made without departing from the spirit and scope of the invention as defined in the appended claims.

I claim:

1. A shoe including an upper adapted for inclusion of a wearer's foot, and an elongate nondetachable sole which combines with the upper to provide support for the wearer's foot, the sole including a midsole intermediate an insole and an outsole, said midsole comprising:

a wedge-shaped rear portion which extends from beneath the wearer's heel to beneath the ball of the wearer's foot, said rear portion including a flat load-bearing surface which increases in thickness continuously from beneath the wearer's heel to beneath the ball of the wearer's foot to provide for forwardly-inclined planting of the wearer's foot; and an arcuate forward portion which extends continuously arcuately forwardly from beneath the ball of the wearer's foot to a forward terminus, said arcuate forward portion arcing continuously forwardly from beneath the ball of the wearer's foot to the forward terminus to accommodate forward rollover of the wearer's foot.

2. The shoe of claim 1, wherein said midsole is formed with a resilient foundation region, said foundation region being defined to include first and second load-bearing areas so as to cushion impact of the wearer's foot during walking.

3. The shoe of claim 2, wherein said midsole is formed to further include a perimeter region which is less resilient than said foundation region, said perimeter region extending at least partially along a perimeter of said midsole so as to oppose sidelateral distortion of the sole.

4. The shoe of claim 3, wherein said perimeter region extends substantially along a perimeter of said rear portion of said midsole.

5. The shoe of claim 1, wherein said rear portion is inclined at an angle of between 2-degrees and 6-degrees.

6. The shoe of claim 1, wherein said rear portion is inclined at an angle of approximately 5-degrees.

7. A shoe including an upper adapted for inclusion of a wearer's foot, and an elongate nondetachable sole which combines with the upper to provide support for the wearer's foot, the sole comprising:

an insole which underlies the wearer's foot;

a midsole which underlies said insole, said midsole having a wedge-shaped rear portion with a flat load-bearing surface which extends from below the wearer's heel to below the ball of the wearer's foot and an arcuate forward portion with an arcuate load-bearing surface which extends from below the ball of the wearer's foot to a forward terminus in a continuous arc, said rear portion increasing in thickness continuously from beneath the wearer's heel to beneath the ball of the wearer's foot to provide for forwardly-inclined planting of the wearer's foot, and said forward portion arcing continuously upwardly from immediately below the ball of the wearer's foot to the forward terminus to accommodate forward roll of the shoe from a forwardly inclined planted posture into a substantially undeformed push-off posture; and an outsole having a generally planar planting surface which underlies said rear portion of said midsole, and an arcuate roll surface which underlies said forward portion of said midsole.

8. A shoe including an upper adapted for inclusion of a wearer's foot, and an elongate nondetachable sole having an insole, a midsole, and an outsole which combine with the upper to provide support for the wearer's foot, said sole comprising:

an elongate, wedge-shaped rear portion which extends from the wearer's heel to the ball of the wearer's foot, said rear portion including a flat load-bearing surface and continuously increasing in thickness from beneath the wearer's heel to beneath the ball of the wearer's foot to provide for planting of the shoe in a planted orientation wherein the shoe is substantiality undeformed and the wearer's foot is forwardly inclined; and a forward portion which extends continuously arcuately forwardly beginning at the ball of the wearer's foot, said forward portion including an arcuately load-bearing surface which tapers forwardly from beneath the ball of the wearer's foot in a substantial arc which extends continuously to a forward terminus of the shoe to accommodate forward roll of the shoe into a push-off orientation wherein the shoe is substantially undeformed and the wearer's foot is rearwardly inclined.

9. The shoe of claim 8, wherein said forward portion tapers in an arc having a radius which approximates a distance between the wearer's heel and the ball of the wearer's foot.

10. The shoe of claim 8, wherein said rear portion and said forward portion meet to define a fulcrum immediately below the ball of the wearer's foot.

11. The shoe of claim 8, wherein said load-bearing surface of said forward portion is inclined relative to said load-bearing surface of said rear portion.

* * * * *